US007699164B2

(12) United States Patent
Cuomo

(10) Patent No.: US 7,699,164 B2
(45) Date of Patent: Apr. 20, 2010

(54) CARRIER AND METHOD

(75) Inventor: Angelo V. Cuomo, Staten Island, NY (US)

(73) Assignee: SJV Food & Beverage Carriers, Inc.NJ (US)

( * ) Notice: Subject to any disclaimer, the term of this patent is extended or adjusted under 35 U.S.C. 154(b) by 362 days.

(21) Appl. No.: 11/804,148

(22) Filed: May 16, 2007

(65) Prior Publication Data

US 2007/0221512 A1 Sep. 27, 2007

Related U.S. Application Data

(63) Continuation-in-part of application No. 10/737,612, filed on Dec. 16, 2003, now Pat. No. 7,267,224, and a continuation-in-part of application No. 10/939,264, filed on Sep. 10, 2004, now Pat. No. 7,604,115, and a continuation-in-part of application No. 11/443,962, filed on May 30, 2006, and a continuation-in-part of application No. 11/804,107, filed on May 16, 2007.

(51) Int. Cl.
*B65D 75/00* (2006.01)

(52) U.S. Cl. ..... 206/162; 206/170; 206/180; 206/175; 206/190; 229/120.23; 229/120.12; 229/120.15

(58) Field of Classification Search ..... 206/139, 206/173, 143, 162, 175, 180, 185, 184, 190, 206/193, 427, 170; 229/120.23, 120.12, 229/120.15, 120.35; 493/51, 90
See application file for complete search history.

(56) References Cited

U.S. PATENT DOCUMENTS 952,302 A 3/1910 Brenner
962,607 A 6/1910 Wood
982,919 A 1/1911 Wood
1,223,202 A 4/1917 Proctor
2,011,232 A 8/1935 Parks et al.
2,026,525 A 6/1936 Korte
2,284,290 A 5/1942 Marshall, Jr.
2,319,380 A 5/1943 Wells
2,339,176 A 1/1944 Lee
2,373,851 A 4/1945 Potter
2,405,517 A 8/1946 Plummer
2,513,079 A 6/1950 Buerger
2,594,376 A 4/1952 Ameson
2,630,264 A 3/1953 Holy
2,813,658 A * 11/1957 Metzger ..... 206/187
2,828,047 A 3/1958 Weiselberg
2,850,223 A 9/1958 Staruss
3,158,286 A 11/1964 Phillips, Jr.
3,266,663 A 8/1966 Ringler
3,547,339 A 12/1970 Bruce
3,576,274 A 4/1971 Stramaglia
3,780,906 A 12/1973 Katzenmeyer (Continued)

*Primary Examiner*—David T Fidei
(74) *Attorney, Agent, or Firm*—Gregor N. Neff, Esq.

(57) ABSTRACT

The carrier has a vertical support structure, a pair of foldable receptacles extending from opposite sides of said vertical support structure. The receptacles have automatically unfolding bottom walls. Each receptacle has at least one divider member extending upwardly and laterally from the upper edge of one side-wall of each receptacle to a reinforcing panel secured to said vertical support structure. The dividers and reinforcing panels are formed in a foldable blank from a single sheet of material and need no gluing to secure them to the carrier structure.

13 Claims, 3 Drawing Sheets

U.S. PATENT DOCUMENTS 3,860,113 A * 1/1975 Helms ..... 206/185
4,047,610 A 9/1977 Stout et al.
4,089,457 A 5/1978 Wood et al.
4,378,880 A 4/1983 Summers
4,402,400 A * 9/1983 Stout ..... 206/162
4,610,349 A 9/1986 Schwartz et al.
4,756,408 A * 7/1988 Grauf ..... 229/108
4,767,051 A 8/1988 Single
4,770,294 A 9/1988 Graser
4,798,285 A 1/1989 Hernandez
4,836,367 A 6/1989 Golkar
5,052,552 A 10/1991 Maroszek
5,415,277 A 5/1995 Bernstein
5,423,420 A 6/1995 Bakx
D367,409 S 2/1996 Hunter
5,501,338 A 3/1996 Preston
5,524,814 A 6/1996 Davis
5,590,762 A * 1/1997 Harrelson ..... 206/162
5,609,379 A 3/1997 Harrelson
5,611,425 A 3/1997 Holley, Jr.
5,624,024 A 4/1997 Miess
5,645,162 A 7/1997 Harrelson
5,695,051 A 12/1997 Hart
5,709,298 A 1/1998 Harris
5,738,217 A 4/1998 Hunter
5,765,684 A 6/1998 Van Dore et al.
5,788,081 A 8/1998 Bates
5,797,486 A 8/1998 Picciolo
5,803,264 A 9/1998 Gersten et al.
5,813,540 A 9/1998 Vollbrecht et al.
5,816,405 A 10/1998 Carriger, Jr.
5,833,056 A 11/1998 Goldman
5,884,756 A 3/1999 Holley, Jr. et al.
5,927,502 A 7/1999 Hunter
5,927,593 A 7/1999 Berkowitz et al.
5,957,276 A 9/1999 Cutler et al.
5,975,287 A 11/1999 Negelen
6,000,536 A 12/1999 Piotrowski
6,168,013 B1 1/2001 Gomes
6,202,836 B1 3/2001 Picciolo
6,230,881 B1 * 5/2001 Collura ..... 206/175
6,341,689 B1 1/2002 Jones
6,443,308 B1 9/2002 Davis
6,571,941 B2 * 6/2003 Holley, Jr. ..... 206/162
6,598,739 B1 7/2003 Collura
2002/0179459 A1 12/2002 Bakx
2003/0213705 A1 11/2003 Woog

* cited by examiner

CARRIER AND METHOD

This patent application is a continuation-in-part of U.S. patent application Ser. No. 10/737,612, filed Dec. 16, 2003 now U.S. Pat. No. 7,267,224, Ser. No. 10/939,264, filed Sep. 10, 2004 now U.S. Pat. No. 7,604,115, Ser. No. 11/443,962, filed May 30, 2006, and Ser. No. 11/804,107 filed on May 16, 2007. The disclosures of those patent applications hereby are incorporated herein by reference.

The foregoing patent applications describe highly advantageous carriers for beverage containers loaded at a plant for delivery to stores, and for the dispensing of food at fast food counters, stadium food counters, etc., and for tall containers such as wine bottles and the like.

The present invention is directed towards providing a carrier of a similar type but which is particularly advantageous for use in carrying relatively tall containers such as wine bottles and the like. Concomitantly, it is an object of the invention to provide the advantageous features of the carrier for use in carrying other objects.

It also is an object of the invention to provide a carrier, a blank, and method of making the carrier from the blank in which dividers for the carrying receptacles provided in the carrier are formed integrally with other portions of the carrier in order to save expense in fabricating the carrier.

It is a further object of the invention to provide such a carrier with an extremely strong bottom structure so that it can carry heavy loads with the use of only relatively light-weight materials, and has automatically-opening bottom structures, as well as structures which hold the carrier open while it is being loaded to prevent the carrier from refolding itself.

In accordance with the foregoing, a carrier is provided with a pair of support panels, a foldable receptacle extending outwardly from each of the support panels, and at least one divider in each of the receptacles, with the divider being formed from the same material which forms a side-wall and a reinforcing panel for the support panel so that strong dividers are provided for dividing the receptacles into compartments for holding beverage containers or other objects.

It is a further object of the invention to provide such a carrier and method in which economical materials can be used, as well as a reduced number of manufacturing steps, so as to minimize the cost of the carrier without compromising its strength and simplicity.

In accordance with the present invention, the foregoing objects are satisfied by the provision of a carrier with a pair of support panels secured together, a foldable receptacle extending from each of the support panels when the carrier is unfolded, with at least one divider being formed in each of the receptacles by material extending from the upper edge of one side-wall of each receptacle, and included in the material of a reinforcing panel secured to the upper portion of the support panel.

Preferably, the dividers are formed by strips of material extending upwardly and laterally from the upper edge of the receptacle side-wall and terminating at the support panel as part of a reinforcing panel.

Also, it is preferred that the bottom structure of each receptacle be of the type opening automatically upon the spreading of the side-walls apart from the support panels. It also is preferred that the bottom structure have means for holding the carrier open after it has been opened, but before it has been loaded with objects to be carried. To that end, the bottom structure preferably includes a pair of opposed flanges forming part of the bottom structure and interlocking when the carrier is at least partially opened so as to hold the carrier open.

It also is preferred that the opposed flanges extend substantially all the way across the bottom wall so as to provide maximum strength.

It also is preferred that the interlocking panels be symmetrical and complementary so that the strength added by the overlapping panels is distributed over the surface of the bottom wall.

It is preferred that a carrier intended to be loaded by hand, such as at a sports stadium check-out stand, fast food restaurant, etc., have a top container such a as a tray adapted to be slipped onto the vertical support structure by way of a slot in the bottom of the top tray, and to rest atop the dividers or have added slots to accommodate the upstanding dividers to facilitate the use of the top container with the carrier.

Other objects and advantages will be set forth in or apparent from the following description and drawings.

IN THE DRAWINGS

GENERAL DESCRIPTION

Figure 1:
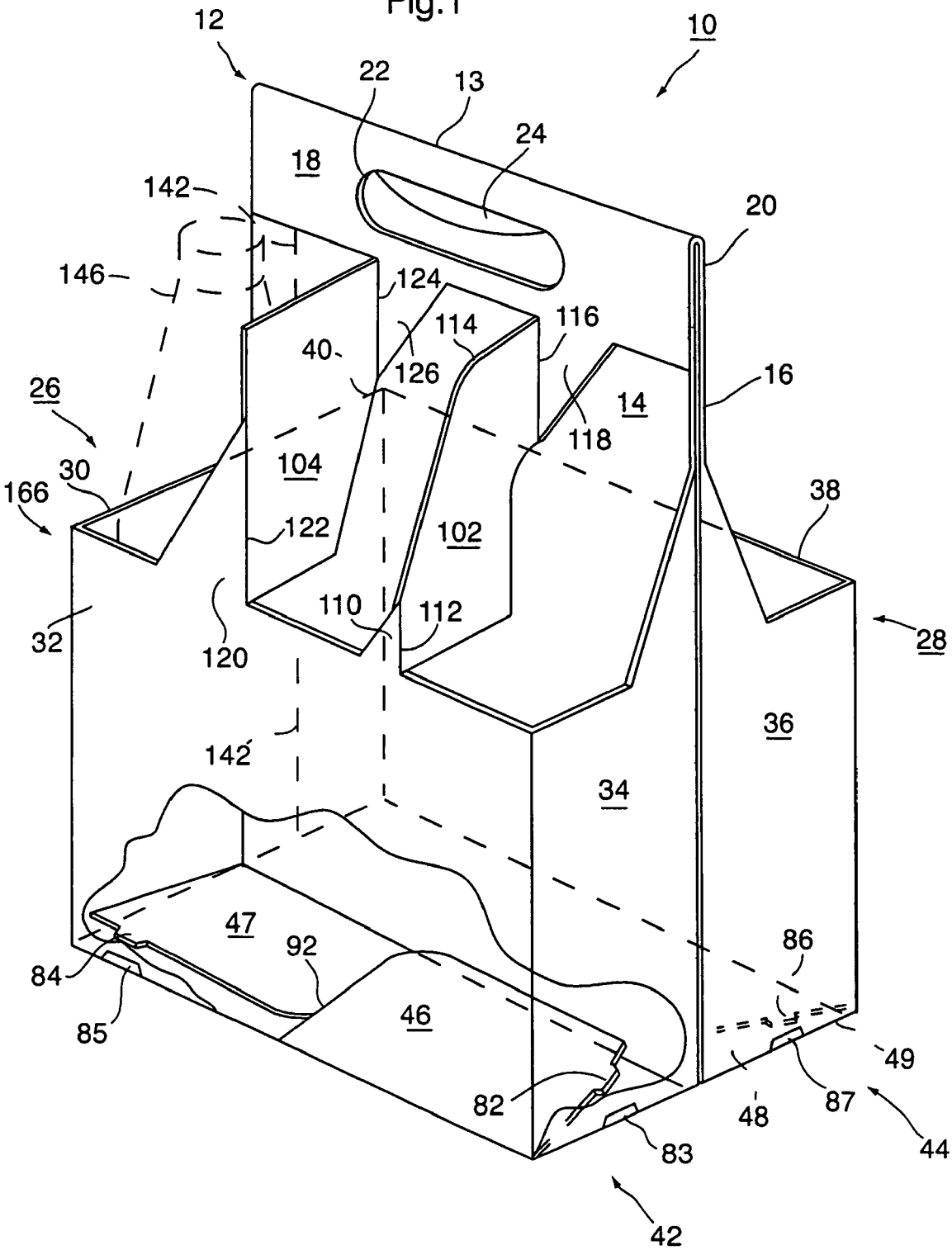
FIG. 1 is a perspective view, partially broken away, of a carrier constructed in accordance with the present invention.

The carrier 10 shown in FIG. 1 includes a vertical support structure 12 comprising a pair of vertical support panels 14 and 16 secured together at their upper edges 13.

Two receptacles 26 and 28 extend outwardly from panels 14 and 16, respectively when the carrier is unfolded as shown in FIG. 1. A2

The receptacle 26 comprises vertical side-wall panels 30, 32, and 34, hinged together along fold lines, and the receptacle 28 includes similarly hinged-together vertical side-wall panels 36, 38 and 40. Preferably, the two series of panels are hinged at fold lines to opposite sides of the vertical panels.

Figure 2:
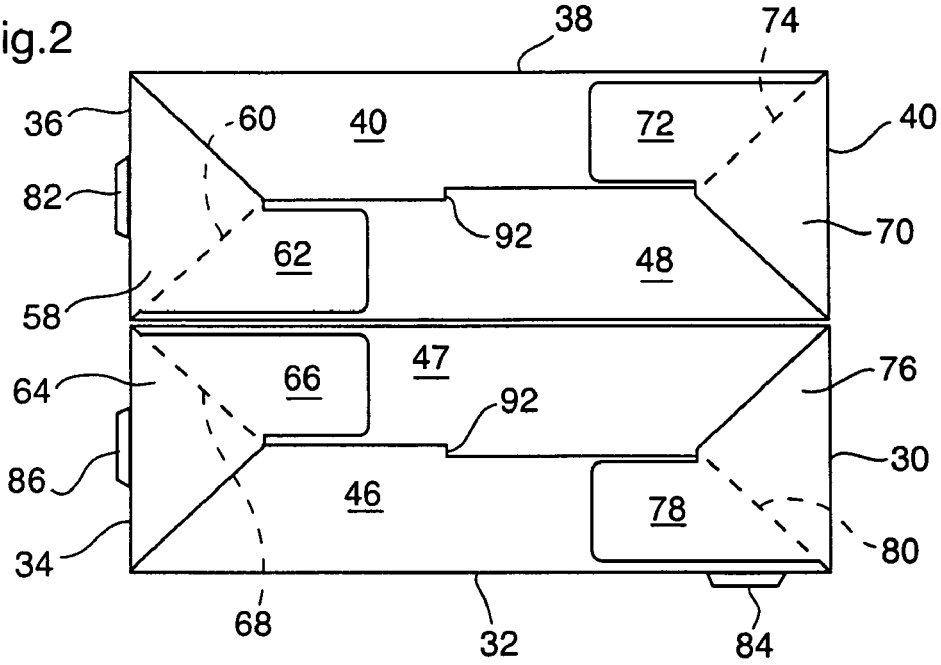
FIG. 2 is a bottom plan view of the bottom of the carrier shown in FIG. 1.
Figure 3:
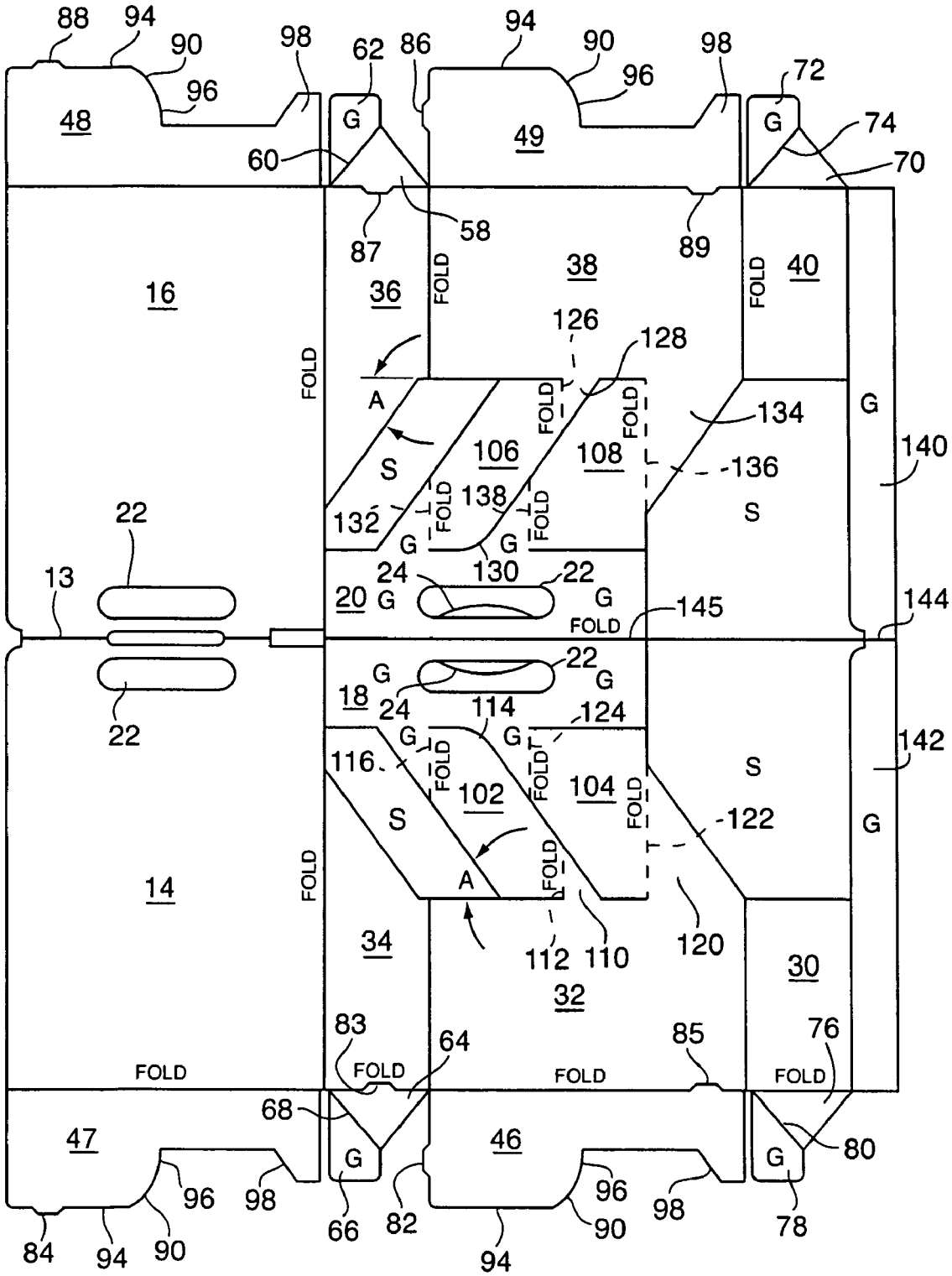
FIG. 3 is a top plan view of a blank used to fabricate the carrier shows in FIGS. 1 and 2.

Referring to FIGS. 2 and 3, as well as FIG. 1, each of the receptacles has a bottom wall structure 42 or 44. Each bottom structure includes a pair of opposed panels 46, 47, or 48, 49 which are complementary in shape with outer edges 94 which extend completely across the bottom structure, and recesses, each with a curved corner 90 and forming a lateral edge 96. Other panels 58, 70, 76, and 64 with glue tabs 62, 72, 78, and 66, respectively, are provided and glued in place as shown in FIG. 2 and as described in greater detail in my foregoing co-pending patent application Ser. No. 11/804,107 filed on May 16, 2007.

The result is that the broad panels 46-49 on the tops of the bottom structures interlock with one another by engaging the lateral edges at location 92 (FIGS. 1 and 2) to hold the carrier open after it has been unfolded to prevent it from relapsing into a folded condition.

The broad flanges 46-49 are symmetrical with respect to one another so that together they cover the entire bottom wall of each receptacle to strengthen it and minimize the chances of local weaknesses in the bottom structure.

Tabs 84 and 88 are provided at the outer edges 94 of the panels 47 and 48, and tabs 82 and 86 at the left edge (as shown in FIG. 3) of the panels 46 and 49. Those tabs fit into slots 85 and 89, respectively, when the panels 46-49 are pressed downwardly by bottles or other containers or other objects being placed on them.

Further details of the highly advantageous bottom structure have been given in the foregoing co-pending patent application Ser. No. 11/804,107, filed on May 16, 2007, and will not be further described herein.

The carrier shown in FIG. 1 is particularly well adapted for carrying relatively tall bottles such as the wine bottle 146 shown in FIG. 1 in dashed lines. Wine bottles are typical examples of such tall bottles. Because they are made of relatively thick glass or other sturdy materials, it is not believed to be necessary to prevent the lower portions of the bottles from clashing against one another while being carried.

In accordance with the present invention, dividers 102 and 104 are provided which extend upwardly from the upper edge of the outer wall 32 or 38, the side-walls which are parallel to the panels 14 and 16. Thus, although the adjacent dividers 102 and 104 (and 106, 108, see FIG. 3) do not separate the bottles from one another in the lower regions, they provide separation of the carrier into separate compartments, and hold the bottles steady to keep them from moving excessively.

Preferably, the dividers are made out of the same materials as the side-wall panels and the reinforcement panels 18 and 20, as it is shown in FIG. 3.

The dividers 102, 104, etc., are strips of fiberboard material extending at an acute angle "A" from the upper edge of the side-walls 32 and 38 and are hinged to the side-wall along lines 112, 122 and 126, 136, and are hinged at the upper end to the reinforcement panels 18 and 20 along lines 116, 124 and 132, 138.

The strips 104 and 108 are secured to the panels 32 and 38 by triangular shaped pieces of material 120 and 134, respectively. Similarly, the strips 102 and 106 are secured to the side-wall panels 32 and 38 by triangular pieces 110 and 128, respectively.

It should be understood that lines along which folds are to be made are indicated by the letter "F" in FIG. 3, and areas to be glued are marked with the letter "G", and unmarked lines are cut lines. Areas to be discarded as scrap are marked with the letter "S".

Handle holes 22 and guards 24 are located in the reinforcement panels 18 and 20, and the holes 22 in panels 18, 20 align with additional holes 22 near the upper edges of the vertical support panels 14 and 16 when the carrier is assembled.

As it is shown in FIG. 1, when the reinforcement panels 18 and 20 are glued onto the upper portions of the vertical support panels 14 and 16, the upper ends of the strips 102, 104, 106, and 108 are automatically anchored to the vertical support structure 12. The distance between the respective hinge lines 112, 116; 122, 124; 136, 138, and 126, 132, are equal to the width of the bottom wall of the receptacle in which the divider is positioned.

When the carrier 10 is unfolded for use, the divider strips bend along the fold lines 112, 116, etc. and assume a position substantially perpendicular to the panels 14 and 16. Thus, they serve as dividers to form compartments in the receptacles.

This construction is highly advantageous. The dividers are formed simply by die-cutting the fiberboard material at the same time as other parts are die-cut to form the blank shown in FIG. 3. Then, the carrier is folded and glued, and the finished carrier is ready for use. No gluing is required to form the dividers.

Two optional elongated attachment flanges 140, 142 are provided at the right edge of the blank shown in FIG. 3. The two flanges are interconnected along the fold line 144.

When the blank is folded, the glued flanges 140, 142 are wrapped around the left edges of the panels 16 and 14 and thus glued to the panels to reinforce the panels.

The specific carrier shown in FIG. 1 has the vertical panels 14 and 16 secured together only along the upper edge. Thus, they are free to swing apart to display advertising appearing on the inside surfaces of the panels 14 and 16, or for access to promotional items etc. This is an example of a so-called "saddlebag" carrier.

It should be understood, however, that the panels 14 and 16 also can be glued together back-to-back, if that form of the carrier is preferred.

When used as a "saddlebag" style carrier, the divider construction of the present invention has the further advantage that it does not use any material from the vertical support panels 14 and 16, thus providing more area on which to print advertising etc. In addition, holes are not made in the vertical panels 14 and 16, thus maintaining their integrity and strength.

In addition, since the dividers need not be glued to the outer walls 32 and 38 of the carrier, there is a reduction of four glue spots to be formed in manufacturing the carrier.

Although the carrier 10 shown in FIG. 1 is primarily intended for use as a pre-packaged beverage carrier, the principles of the invention can be used in a carrier loaded by hand and used to carry food from a concession stand or fast food restaurant etc.

Figure 4:
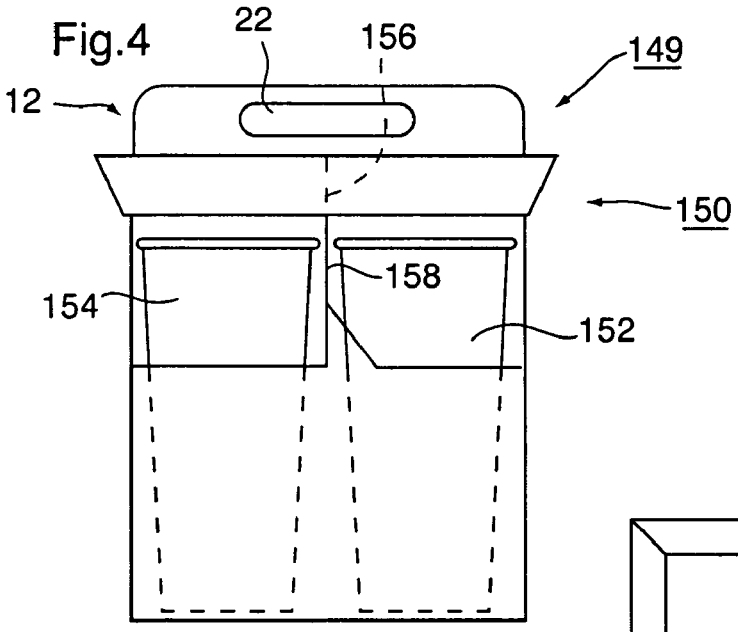
FIG. 4 is a side elevation view showing an alternative embodiment of the carrier of the present invention.

FIG. 4 shows the carrier 149 having only one divider 158 in each of the two receptacles, thus forming four relatively large compartments particularly useful for holding tall and large diameter beer or soft drink cups 152, 154.

Figure 5:
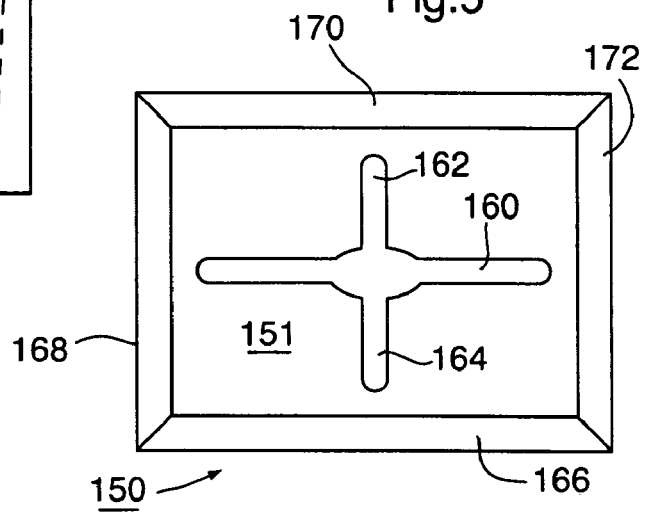
FIG. 5 is a top plan view of a top container used in the embodiment of FIG. 4.

In addition, a top tray 150, shown in FIG. 5 as well as FIG. 4, is provided. The tray 150 has a bottom wall 151, and foldable sidewalls 166, 168, 170 and 172 extending upwardly from the bottom wall 151. The bottom wall 151 has a long slot 160 through which the upper edge of the vertical support structure 12 is thrust. If desired, the bottom wall can rest on the upper edge of the divider 158. Alternatively, the bottom wall 151 has an additional pair of slots 162, 164 so that the upper edges of the divider in each receptacle extend into the tray as indicated at 156 in FIG. 4.

The tray provides additional space for solid foods, etc., as it is more fully described in my prior co-pending patent applications.

If desired, the tray 150 can be replaced by a covered container, with or without interior barriers for containing specific types of food items.

The above description of the invention is intended to be illustrative and not limiting. Various changes or modifications in the embodiments described may occur to those skilled in the art. These can be made without departing from the spirit or scope of the invention.

What is claimed is:

1. A carrier comprising a pair of support panels secured to one another and forming a support panel structure, a pair of folding receptacles, each extending outwardly from said support panel structure on opposite sides thereof, each of said receptacles including its own separate folding bottom wall structure and a plurality of side-wall panels secured together and to one of said support panels along fold lines, and including one side-wall panel having an upper edge and a lower edge and being spaced from and substantially parallel to the adjacent support panel when said carrier is unfolded, at least one divider member extending upwardly and laterally from the upper edge of said one side-wall panel and being secured at its upper portion to said adjacent support panel, in which each of said separate folding bottom wall structures includes a plurality of flanges, each extending from the bottom edge of one of said side-wall panels and said support panels, said flanges being interconnected to automatically unfold to form a bottom wall when said carrier is unfolded.

2. A carrier as in claim 1 in which said divider member extends upwardly at an acute angle for a major portion of its length.

3. A carrier as in claim 1 in which said support panels have upper portions, and including a handle structure in said upper portions of said support panels.

4. A carrier as in claim 1 in which two of said flanges, one extending from said support panel and the other from said one panel, are shaped complementarily to automatically interlock with one another and hold said carrier open when said carrier is unfolded.

5. A carrier as in claim 1 in which said divider member is formed from reinforcing sheet material, the remainder of which, after removal of said divider member therefrom is secured to the adjacent support panel.

6. A carrier as in claim 1 including a foldable top container having a bottom wall and side-walls extending from said bottom wall, said bottom wall having a first slot for receiving said support panel structure therethrough, and another slot for receiving said divider member therethrough.

7. A blank for making a carrier, said blank having a single sheet of material forming a pair of support panels, each having an upper portion, a pair of automatic-opening bottom structures, each of said support panels extending to one of said bottom structures, a series of side-wall panels secured to each of said support panels, and forming, with one of said support panels a pair of receptacles, each receptacle having a separate one of said bottom structures, a reinforcing sheet of material secured to said upper portion of each of said support panels, and at least one divider structure for each support panel, including at least one strip of material integral formed from said reinforcing sheet and with one of said side-wall panels at a lower end, and extending upwardly and laterally to said reinforcing sheet at the upper end when said carrier is unfolded.

8. A blank as in claim 7, each of said bottom structures including a plurality of flanges each of said support panels and side-wall panels having a lower edge, said flanges being attached along fold lines to and extending from said lower edges of said support panels and side-wall panels to form, when secured together, an automatically opening foldable bottom panel for each of two receptacles formed by said side-wall and support panels.

9. A blank as in claim 7, one of said side-walls being spaced from and parallel to said support panel when said carrier is unfolded, said strip extending at an acute angle with said side-wall panels so that said strip bends to form a barrier substantially perpendicular to said support panel and spanning the distance between said support panel and said one side wall panel.

10. A blank as in claim 7 including a pair of elongated attachment flanges, each located at one end of each series of side-wall panels, each attachment flange being approximately the same length as one of said support panels and being secured to the other of said attachment flanges at one end.

11. A carrier comprising a pair of vertical support panels secured together and forming a vertical support panel structure, each of said vertical support panels having an upper portion and a lower portion, with a handle structure in said upper portion, and having an upper and a lower edge, a pair of foldable side-wall structures, each having three side-walls, each having an upper and a lower edge and forming, with said lower portion of one of said vertical support panels, a receptacle extending outwardly from said support panel structure when said carrier is unfolded, said upper portions extending substantially above said upper edges of said side-walls, each of said foldable side-wall structures having a flange extending downwardly from each of said lower edges of the side-walls and said vertical support panel forming each of said receptacles, said flanges being selectively secured together to automatically fold upwardly into said carrier when said carrier is folded, and fold downwardly to form a bottom wall when said carrier is unfolded, and at least one divider member extending upwardly from the upper edge of one of said side-walls to said upper portion of one of said vertical support panels in each of said receptacles.

12. A carrier as in claim 11 in which each of said vertical support panels is a two-ply structure, with each of said divider members being formed by a cut-out portion of one of the two plies, said one ply being secured to the other as a reinforcement.

13. A carrier as in claim 11 including a top-tray with a bottom-wall, sidewalls, and a pair of transverse slots in said bottom wall, said slots being sized and positioned to receive said upper portions of said vertical support panels and said dividers when said top-tray is positioned atop said carrier.

* * * * *